US012359899B2

(12) United States Patent
Peterson

(10) Patent No.: US 12,359,899 B2
(45) Date of Patent: Jul. 15, 2025

(54) REDUCED TENSION CARTRIDGE CASE WITH TWO-STAGE NECK

(71) Applicant: Federal Cartridge Company, Anoka, MN (US)

(72) Inventor: Bryan P. Peterson, Isanti, MN (US)

(73) Assignee: Federal Cartridge Company, Anoka, MN (US)

( * ) Notice: Subject to any disclaimer, the term of this patent is extended or adjusted under 35 U.S.C. 154(b) by 48 days.

(21) Appl. No.: 18/298,808

(22) Filed: Apr. 11, 2023

(65) Prior Publication Data

US 2023/0324153 A1 Oct. 12, 2023

Related U.S. Application Data

(60) Provisional application No. 63/329,870, filed on Apr. 11, 2022.

(51) Int. Cl.
*F42B 5/02* (2006.01)
*F42B 5/28* (2006.01)

(52) U.S. Cl.
CPC ..... *F42B 5/025* (2013.01); *F42B 5/28* (2013.01)

(58) Field of Classification Search
CPC .. F42B 5/025; F42B 5/02; F42B 5/067; F42B 5/26; F42B 5/28
See application file for complete search history.

(56) References Cited

U.S. PATENT DOCUMENTS 2,455,080 A 11/1948 Miller et al.
2,482,132 A * 9/1949 Studler ..... F42B 14/064 102/501
3,209,691 A 10/1965 Herter
3,477,374 A 11/1969 Barr
3,749,020 A * 7/1973 Weyhmuller ..... F42B 5/073 86/18
4,483,251 A 11/1984 Spalding
4,682,545 A 7/1987 Jett, Jr.
5,259,288 A * 11/1993 Vatsvog ..... F42B 5/307 102/467
5,708,231 A 1/1998 Koon
5,822,904 A * 10/1998 Beal ..... F42B 5/025 89/14.05
8,443,730 B2 * 5/2013 Padgett ..... F42B 5/313 102/466

(Continued)

FOREIGN PATENT DOCUMENTS

EP 0238155 A1 1/1987
GB 189611747 A 5/1986

(Continued)

OTHER PUBLICATIONS

"Case Neck Length" https://forum.accurateshooter.com/threads/case-neck-length.3972070/.

(Continued)

*Primary Examiner* — Jonathan C Weber

(74) *Attorney, Agent, or Firm* — Christensen, Fonder, Dardi & Herbert PLLC; Timothy J. Busse

(57) ABSTRACT

Devices and methods for reducing tension force on a projectile by a neck of a cartridge case. A two-stage neck has a clearance band and an interference band, the clearance band providing a reduced retention force on the projectile relative to the interference band.

20 Claims, 6 Drawing Sheets

(56) References Cited

U.S. PATENT DOCUMENTS

| | | | | |
|---|---|---|---|---|
| 8,869,702 | B2 * | 10/2014 | Padgett | F42B 5/067 102/466 |
| 8,875,633 | B2 * | 11/2014 | Padgett | F42B 5/313 102/466 |
| 9,395,163 | B2 | 7/2016 | Fritz | |
| 9,587,919 | B2 | 3/2017 | Daniau | |
| 11,209,251 | B2 | 12/2021 | Burrow et al. | |
| 2005/0188879 | A1 | 9/2005 | Wiley et al. | |
| 2012/0180688 | A1 * | 7/2012 | Padgett | F42B 5/30 102/466 |
| 2014/0060372 | A1 * | 3/2014 | Padgett | F42B 5/067 102/466 |
| 2014/0290522 | A1 * | 10/2014 | Padgett | B29C 69/001 102/466 |
| 2021/0223009 | A1 | 7/2021 | Peterson et al. | |

FOREIGN PATENT DOCUMENTS

| | | | | |
|---|---|---|---|---|
| WO | WO-9513516 | A1 * | 5/1995 | F42B 5/067 |
| WO | WO2000034732 | A1 | 6/2000 | |

OTHER PUBLICATIONS

"Stepped Neck Benchrest Cases" https://forum.cartridgecollectors.org/t/stepped-neck-benchrest-cases/6528; accessed Mar. 10, 2022.

"Lyman Neck Expanding Pistol (M) Dies" https://www.tactical-store.com/ts-ly-gt-neckexppdie.html; accessed Mar. 10, 2022.

"Unknown cartridge, possibly experimental" https://forum.cartridgecollectors.org/t/unknown-cartridge-possibly-experimental/12487; accessed Mar. 10, 2022.

"A Double-Shoulder Cartridge Case" https://www.stripersonline.com/surftalk/topic/710150-a-double-shoulder-cartridge-case/; accessed Mar. 10, 2022.

"Another "Stepped" 9mm Case" https://czfirearms.us/index.php?topic=85963.30; accessed Mar. 10, 2022.

"Stepped Brass Ammo Casings" https://www.glock.pro/threads/stepped-brass-ammo-casings.10803/; accessed Mar. 10, 2022.

* cited by examiner

REDUCED TENSION CARTRIDGE CASE WITH TWO-STAGE NECK

CROSS-REFERENCE TO RELATED APPLICATION

This application claims the benefit of U.S. Provisional Patent Application No. 63/329,870, filed Apr. 11, 2022, entitled REDUCED TENSION CARTRIDGE CASE WITH TWO-STAGE NECK, which is hereby incorporated by reference herein in its entirety.

FIELD OF THE INVENTION

The present invention is directed to ammunition cartridge casing modifications for improving performance.

BACKGROUND OF THE INVENTION

In an ammunition cartridge for a firearm, a casing holds a projectile (e.g., a bullet). Retention force is the amount of force that would be necessary to pull the projectile from the casing. Cartridge design may impact cartridge parameters such as retention force, shelf-life, durability, and/or manufacturing processes along with ballistic performance such as reliability, accuracy, and/or muzzle energy, among other aspects.

SUMMARY OF THE INVENTION

A cartridge for a firearm comprises a projectile and a case. The case comprises a base configured to hold a primer, a body extending from a first end adjacent the base to a second end, and a two-stage neck adjacent the second end of the body and configured to retain the projectile, the two-stage neck comprising a neck length, an interior, and an exterior. The interior of the two-stage neck comprises an interference band that is adjacent the second end of the body and comprises an interference diameter extending an interference length along the two-stage neck, the interference band configured to provide an interference fit with the projectile resulting in an interference retention force. The interior of the two-stage neck also comprising a clearance band comprising a clearance diameter and extending a clearance length along the two-stage neck, the clearance diameter being greater than the interference diameter, the clearance band configured to provide an interference fit with the projectile resulting in a clearance retention force, and a transition portion located between and adjoining the interference band and the clearance band. The interference retention force is greater than the clearance retention force, both the interference band and the clearance band are at least partially coextensive with the projectile, and one or more of the interference length and the clearance length comprise about 25% or more of the two-stage neck length.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
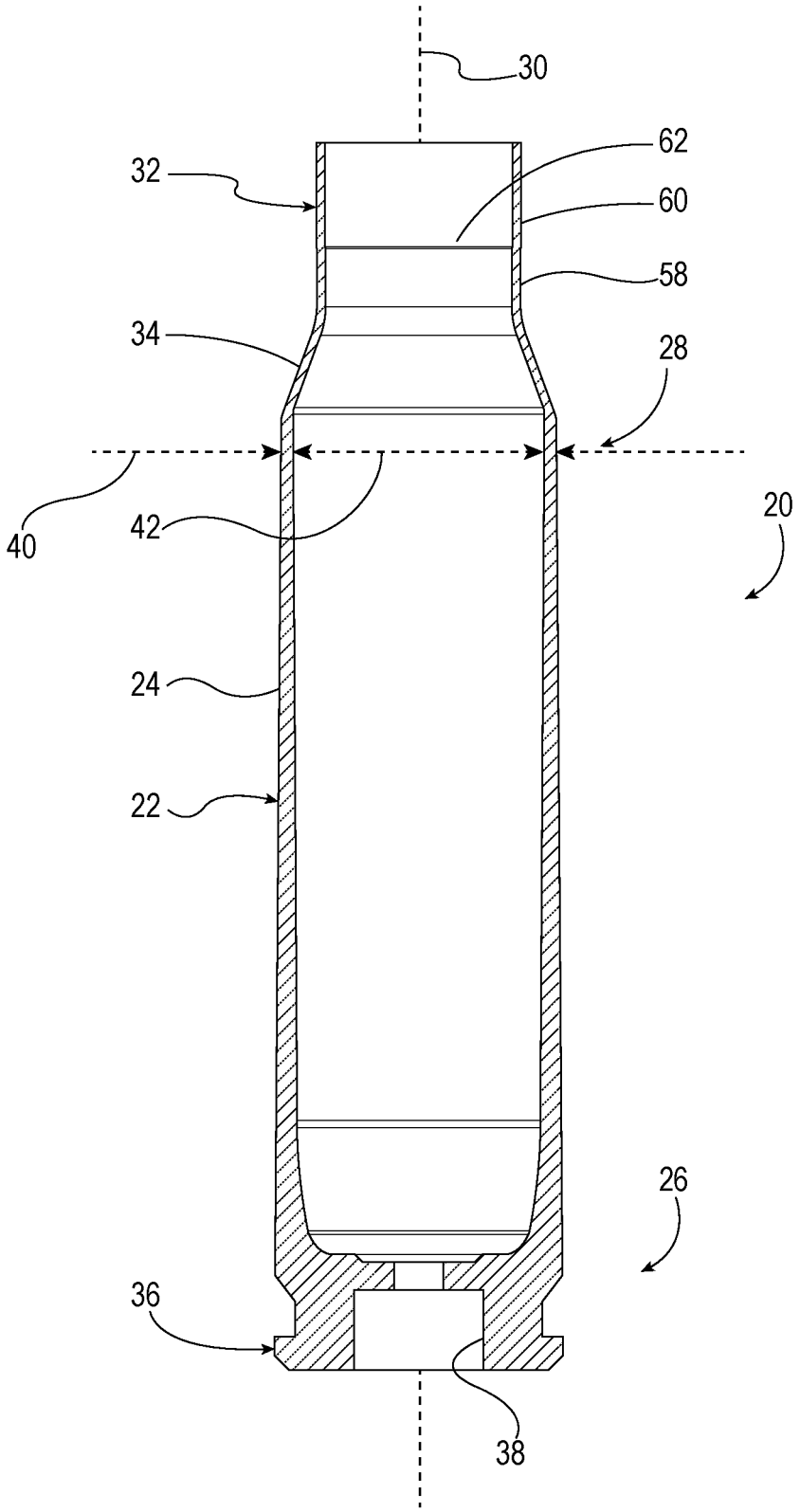
FIG. 1 is a cross-sectional elevation view of an example case of an ammunition cartridge in accord with embodiments of the present disclosure.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 8:
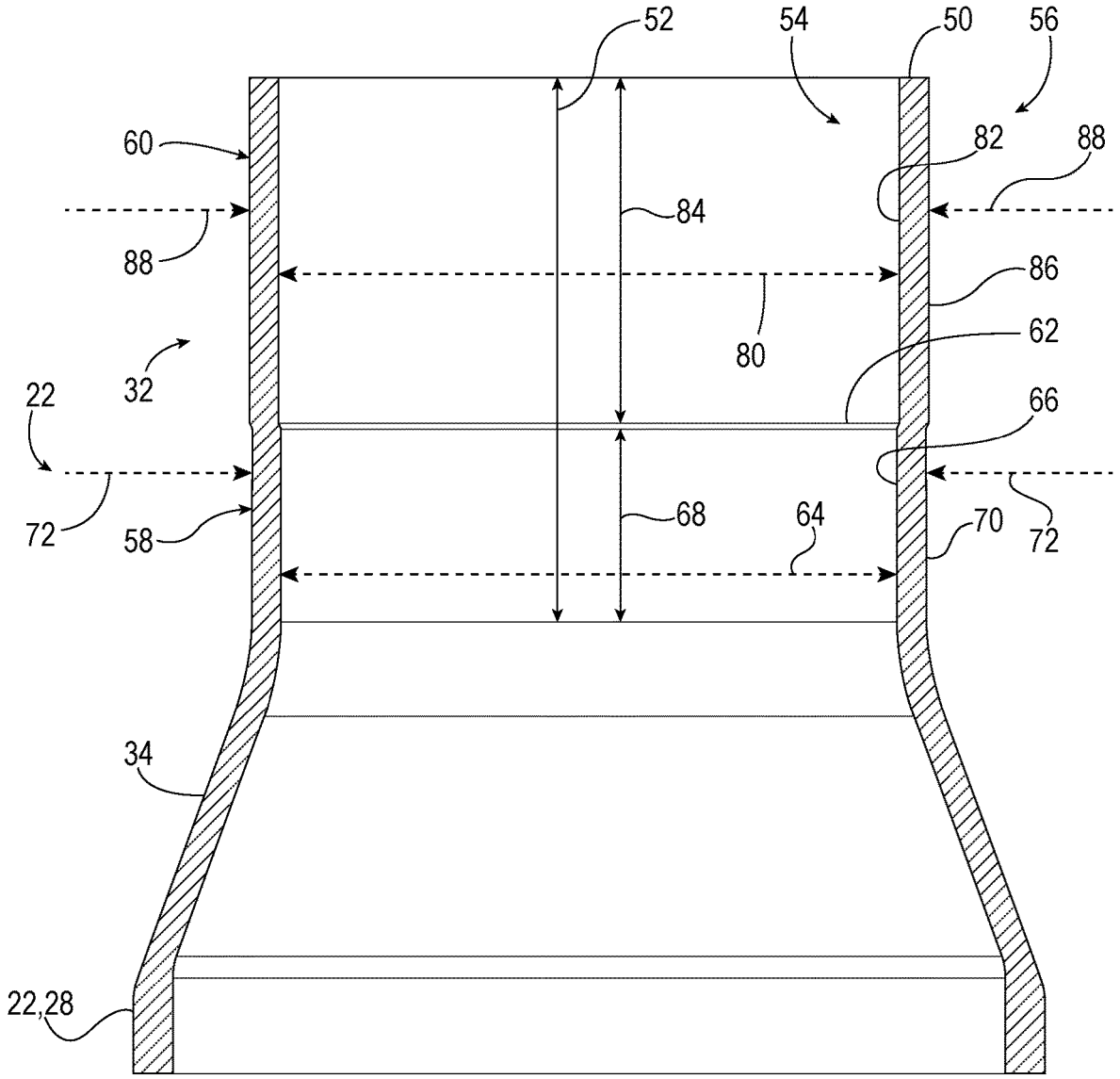
FIG. 8 is the view of FIG. 2 with some features shown closer to actual scale.

Relevant to all of the figures disclosed herein, certain features of the present invention may be exaggerated for clarity and illustrative purposes only. Generally, many applicable standard cartridges have an exterior neck diameter less than 0.5000", including diameters as low as of 0.220" or less. Some embodiments of the present disclosure relate to modifications to the interior and/or exterior diameter of a cartridge neck, such as, for example, modifications that are in the range of approximately 0.0001"-0.0010". As such, the modifications may be difficult to see with the naked eye and/or inside the range of conventional manufacturing tolerances. As one example, FIG. 2 exaggerates the relative diameters of an interference band 58 and a clearance band 60, whereas FIG. 8 shows the same view with relative diameters that are closer to the actual scale of one embodiment of the present disclosure.

Referring to FIG. 1, embodiments of the present disclosure are directed to a cartridge 20 of firearm ammunition (projectile not shown) comprising a case 22 that includes a body 24 extending from a first end 26 to a second end 28 along a central axis 30. The body 24 of the case 22 may have an exterior diameter 40 and an interior diameter 42. A two-stage neck 32 of the case 22 is adjacent the second end 28 of the body 24 and is designed to hold a projectile 100 (not shown, see FIG. 5). In some embodiments the two-stage neck 32 has a reduced diameter relative to the body 24 and the case 22 comprises a shoulder 34 between the two-stage neck 32 and the second end 28 of the case 22. In embodiments, the case 22 comprises a base 36 at the first end 26. The base 36 may hold a primer in a primer hole 38. The case 22 may be formed of various materials such as conventional brass or higher-strength metals such as steel, steel alloys, steel-boron alloys, aluminum, and the like, as discussed further below.

Figure 2:
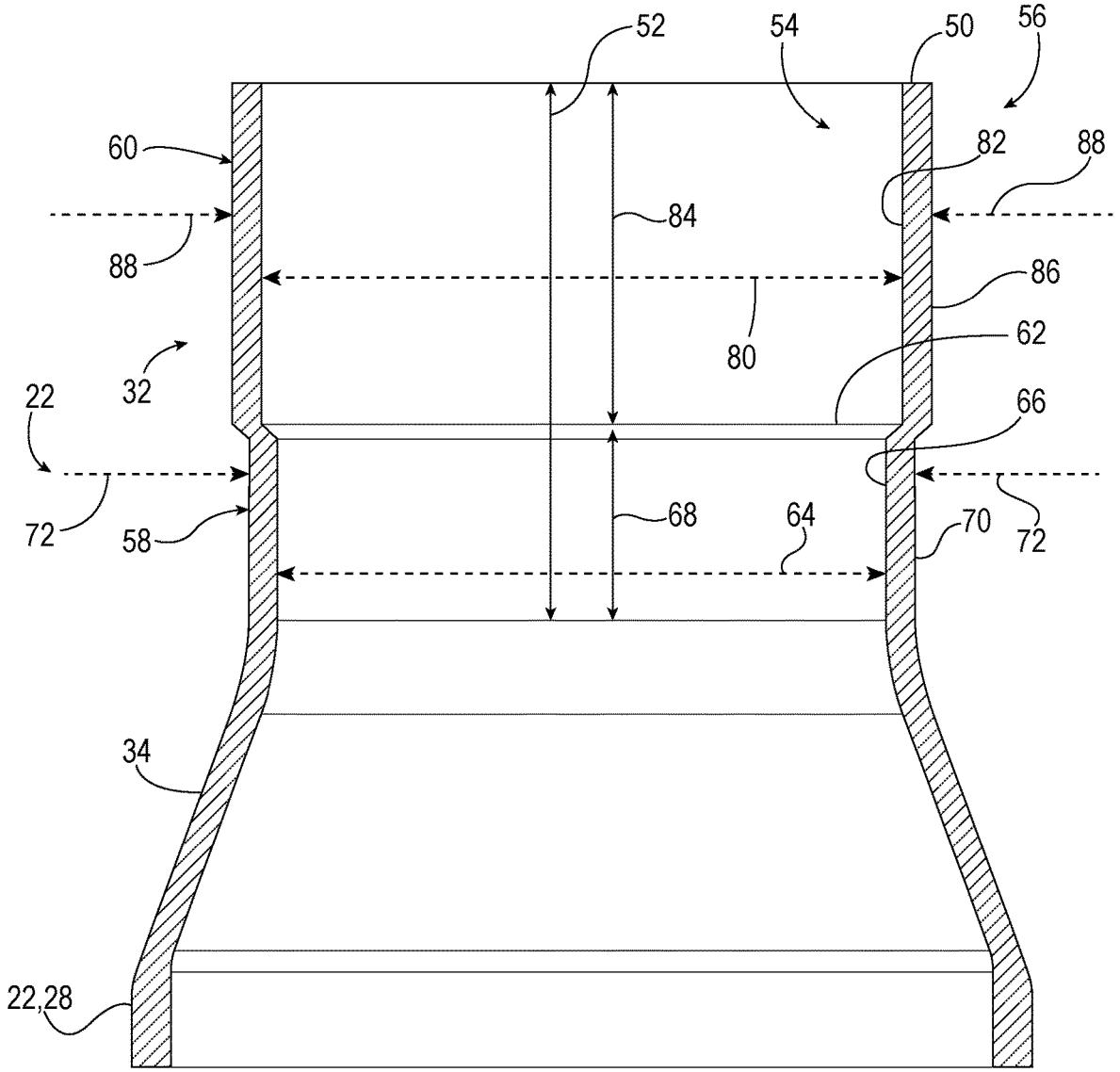
FIG. 2 is a partial zoomed view of the case of FIG. 1.

Referring also to FIG. 2, one embodiment of the two-stage neck 32 extends from the shoulder 34 to a terminal edge 50 to define an overall neck length 52 and comprises an interior 54 and an exterior 56. In certain embodiments, the stages of the two-stage neck 32 are comprised of an interference band 58 and a clearance band 60 with a transition 62 between. In embodiments, the interference band 58 and the clearance band 60 are formed on both the interior 54 and the exterior 56 of the two-stage neck. In other embodiments, the interference band 58 and the clearance band 60 are formed only on the interior 54 while the exterior 56 provides a cylindrical or substantially cylindrical shape with a substantially consistent outer diameter along the neck length 52 that does not mirror corresponding changes in the inner diameter.

In certain embodiments, the interference band 58 comprises an interference diameter 64 of an interior surface 66 and extends for an interference length 68 along the two-stage neck 32. An exterior surface 70 of the interference band 58 comprises an exterior diameter 72. In some embodiments, the interference band 58 may provide an interference fit when the projectile 100 engages the interior surface 66 to be positively held in the case 22, resulting in an interference retention force. In these embodiments, the interference band 58 is at least partially coextensive with the projectile 100 and is not positioned entirely behind the projectile when the projectile is seated in the case.

The design of the interference band 58 may be tuned to a desired interference retention force that precludes or reduces the need for crimping after the projectile 100 is seated. In other words, the number of crimps and/or the degree of crimping may be reduced or eliminated for any one or more crimps along the two-stage neck 32 and/or at the terminal edge 50. For example, the interference retention force may be tuned by changing the interference length 68, the interference diameter 64, selecting a case material with different rigidity, changing the thickness of the two-stage neck 32 at the interference band 58, changing the angle of the interference band 58 to be an increasing or decreasing diameter towards the clearance band 60, changing geometry of the clearance band 60, or the like.

In some embodiments, the interference retention force may be increased by one or more crimps (not shown) pressing the interference band 58 radially inwardly into the projectile 100 and/or pressing the clearance band 60 radially inwardly into the projectile (for example, a mouth crimp). However, as discussed further below, other embodiments of the present disclosure provide a desired retention force without the need for any crimping, interfitting parts, or the like.

In some embodiments, the clearance band 60 comprises a clearance diameter 80 of an interior surface 82 and extends a clearance length 84 along the two-stage neck 32. In certain embodiments, the clearance diameter is greater than the interference diameter 64. An exterior surface 86 of the clearance band 60 comprises an exterior diameter 88. In various embodiments, the clearance band 60 may provide different fits with a projectile 100 including an interference fit with the clearance diameter 80 less than the projectile diameter and providing some retention force, a line-to-line fit with the clearance diameter 80 substantially equal to the projectile diameter and providing minimal retention force relative to the retention force provided by the interference band 58, or a clearance fit with the interior surface 82 radially spaced from the projectile 100.

The fit of the clearance band 60 with the projectile 100 results in a clearance retention force. In embodiments with a clearance fit, the clearance retention force may be 0%, or substantially zero percent, or about 0%-5%, about 5%-15%, about 15%-25%, about 25%-35%, about 35%-45%, about 45%-55%, about 55%-65%, about 65%-75%, about 75%-85%, between 85%-75%, and ranges therebetween. In any disclosed embodiments, the clearance band 60 is at least partially coextensive with the projectile when the projectile is seated in the case, in order to provide the fit and other benefits disclosed herein; therefore, the clearance band is not positioned entirely behind or in front of the projectile 100 when the projectile is seated in the case.

In certain embodiments, the two-stage neck 32 may provide an overall retention force on a projectile 100 that may be either a combination of the clearance and interference retention forces or may be equivalent to the interference retention force alone. In some embodiments, the interference retention force constitutes the entire or substantially the entire overall retention force of the two-stage neck 32 on the projectile. In some embodiments, the clearance diameter 80 is greater than or equal to the interference diameter 64 and the clearance retention force is less than the interference retention force. In certain embodiments, the clearance diameter is greater than the interference diameter by a range of about 0.0001-0.0050", about 0.0001-0.0040", about 0.0001-0.0030", about 0.0001-0.0020", about 0.0001-0.0010", about 0.0001-0.0005", and ranges therebetween. In embodiments, the interior surface 82 of the clearance band 60 (or the entire interior 54 of the two-stage neck 32) comprises clearance portions that have a diameter greater than the interference diameter, for example axially-extending grooves, concave dimples, or the like, resulting in the clearance band 60 providing relatively less contact with the projectile 100 than the interference band 58 or a conventional neck of the same material. In embodiments, the clearance band 60 comprises a material with lower strength and/or rigidity than a material that comprises the interference band 58.

The neck length 52 is a combination of the interference length 68 and the clearance length 84 and also may include a length of the transition 62 and/or a mouth 90 if present. In embodiments, the interference length 68 comprises about 10% of the neck length 52; in other embodiments, the interference length comprises about 15%, about 20%, about 25%, about 30%, about 35%, about 40%, about 45%, about 50%, about 55%, about 60%, about 65%, about 70%, or about 75% of the neck length, and ranges that include combinations of any such interference lengths. As such, in embodiments, the clearance length 84 comprises about 90% of the neck length 52; in other embodiments, the clearance length comprises about 85%, about 80%, about 75%, about 70%, about 65%, about 60%, about 55%, about 50%, about 45%, about 40%, about 35%, about 30%, or about 25% of the neck length, and ranges that include combinations of any such clearance lengths. In another sense, embodiments of the present disclosure provide both the interference length 68 and the clearance length 84 comprising at least 10%, at least 15%, at least 20%, at least 25%, at least 30%, at least 35%, and at least 40% of the neck length 52, and ranges that include combinations of any such lengths. In still another sense, embodiments of the present disclose provide one or more of the interference length 68 and the clearance length 84 comprising about 10-90%, about 15-85%, about 20-80%, about 25-75%, about 30-70%, or about 35-65% of the neck length 52. In one embodiment, a two-stage neck 32 comprises a neck length 52 of about 0.300" and the interference length 68 is about 15% or about 0.050" and the clearance length 84 is about 85% or about 0.250".

It will be appreciated that the disclosed embodiments of the interference band 58 are distinct from a conventional crimp, an abutting seat, other retention enhancements, or other incidental features of a case. A conventional case crimp forms a projection in an interior neck surface toward the projectile, but the interior neck surface then continues on both sides of the crimp at a consistent diameter. Therefore a crimp necessarily has two transitions: one inward from the surface and one outward back to the surface. By contrast, embodiments of the present disclosure provide only a single transition 62 between surfaces of different diameters. Additionally, in certain embodiments, the projectile 100 does not have any complementary features or shapes relative to the transition 62 and is not penetrated by, and does not otherwise mirror, the transition 62.

Referring to the embodiment illustrated in FIGS. 1-2, the interference band 58 is positioned interior or rearward of the clearance band 60. The interference band 58 in embodiments without a shoulder 34 extends from the second end 28 of the body 24 of the case 22 to the clearance band 60. In embodiments with a shoulder 34, the interference band 58 extends from the end of the shoulder to the clearance band 60. In certain embodiments, the exterior 56 of the two-stage neck 32 comprises the exterior diameter 88 at the clearance band 60 being greater than the exterior diameter 72 at the interference band 58. In other embodiments such as FIG. 3 discussed below, the exterior diameter 388 at the clearance band 360 is equal to or substantially equal to the exterior diameter 372 at the interference band 358.

In FIGS. 1-2, embodiments of the interior and exterior surfaces of the interference and clearance bands 58, 60 are substantially straight walls when viewed in cross-section, extending parallel to the central axis 30. In some embodiments, the interior surface 82 of the clearance band 60 is substantially cylindrical; in other words, the clearance diameter 80 is substantially consistent along the clearance band 60 to the terminal edge 50 of the two-stage neck 32. In certain embodiments, the interior surface 66 of the interference band 58 is substantially cylindrical; in other words, the interference diameter 64 is substantially consistent along the interference band 58. In other embodiments, one or more of the interior surfaces 66, 82 and/or exterior surfaces 70, 86 may have other shapes, such as curved, concave or convex, and also tapering toward the terminal edge 50, and tapering toward the body 24 of the case, or combinations thereof.

Referring to FIGS. 3-7, in various embodiments, features of the two-stage neck 32 may be rearranged or modified without departing from the scope of the present disclosure. Aspects of any of the disclosed embodiments may be combined or omitted while still providing the benefits of the two-stage neck 32.

Figure 3:
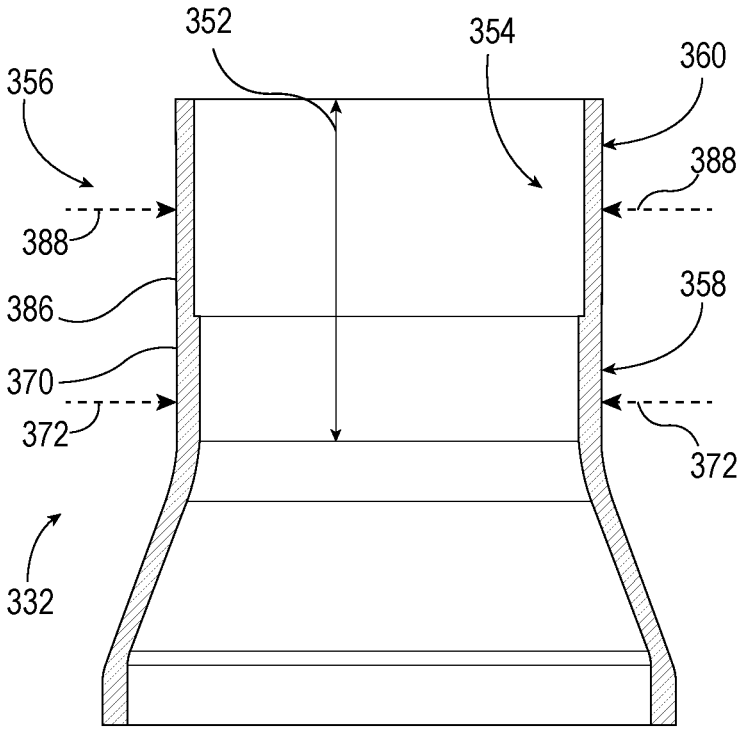
FIG. 3 is a partial zoomed view of another embodiment of a case of FIG. 1 in accord with embodiments of the present disclosure.

Referring to FIG. 3, in certain embodiments the two-stage neck 332 comprises an interior 354 that is the same as FIGS. 1-2, but the exterior 356 and exterior surface 386 may be substantially cylindrical along the entire neck length 352 and does not change in diameter from the interference band 358 to the clearance band 360. In other words, the exterior diameter 370 of the interference band 358 is substantially the same as the exterior diameter 388 of the clearance band 360.

Figure 4:
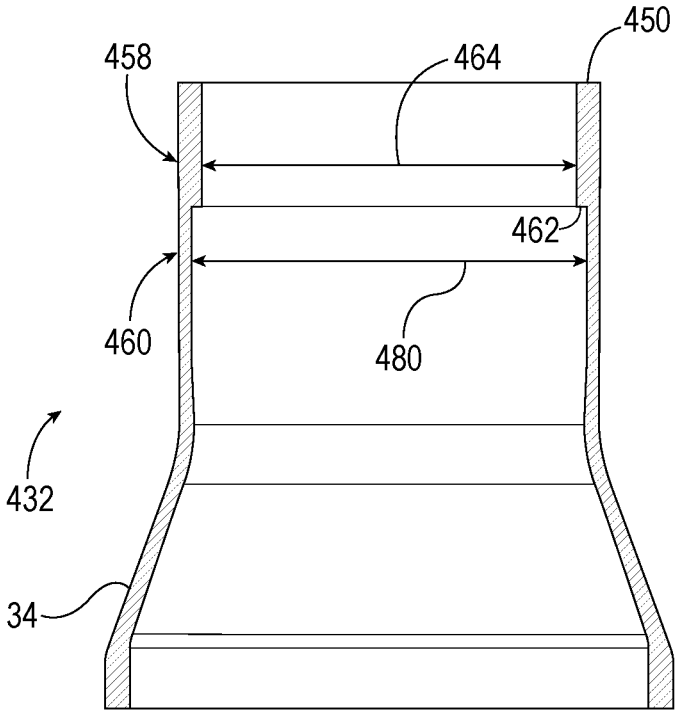
FIG. 4 is a partial zoomed view of still another embodiment of a case of FIG. 1 in accord with embodiments of the present disclosure.

Referring to FIG. 4, in some embodiments the two-stage neck 432 comprises reversed positions for interference band 458 and the clearance band 460. The interference band 458 comprises the terminal edge 450 and extends to the transition 462 at the interference diameter 464. The clearance band 460 extends from a transition 462 to the shoulder 34 (or to the second end 28 of the body 24) at the clearance diameter 480. To form the two-stage neck 432, the steps for forming the clearance band 460 may be performed by reaching through the case 22, for example from the base 36.

Figure 5:
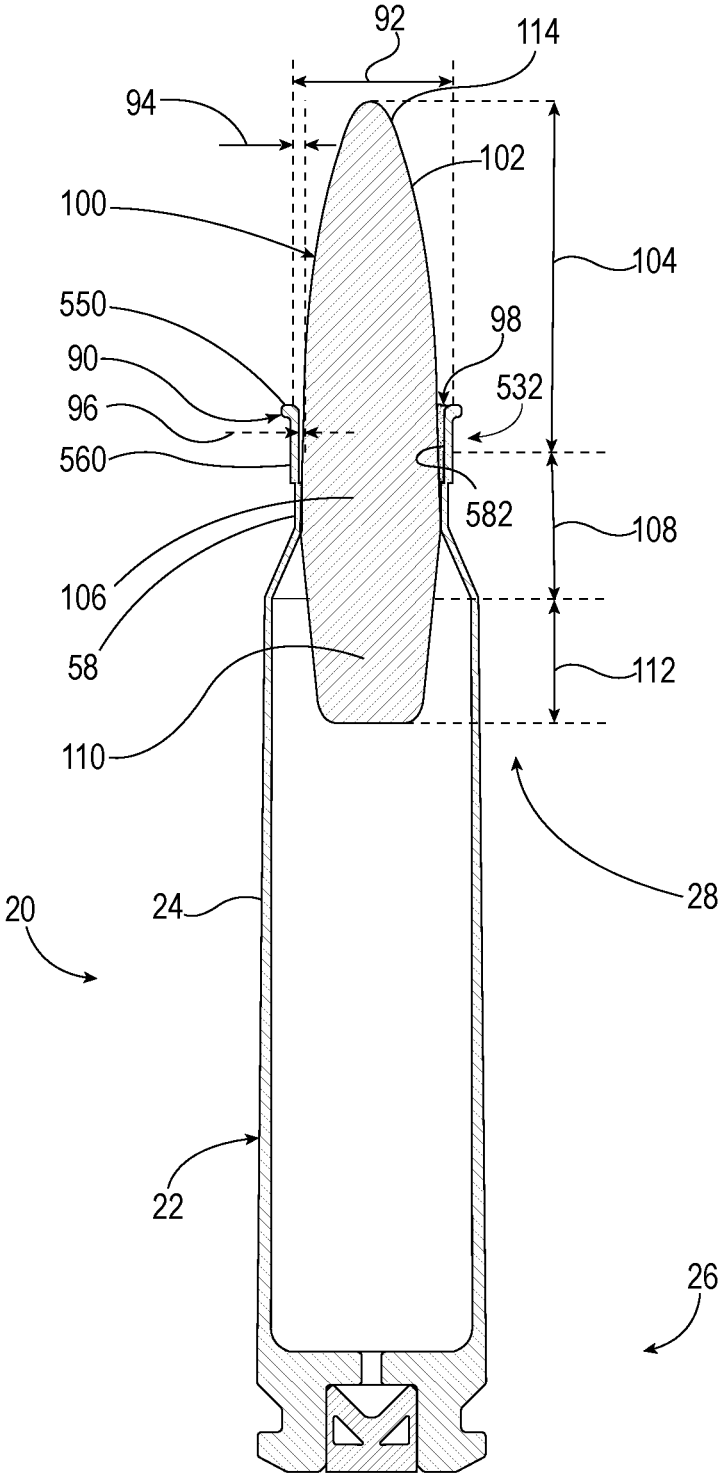
FIG. 5 a partial zoomed view of an embodiment of a case of FIG. 1 and retaining an example projectile in accord with embodiments of the present disclosure.

Referring to FIG. 5, in some embodiments a two-stage neck 532 is similar to FIGS. 1-2 and further includes a mouth 90 formed in a clearance band 560, the mouth flares radially outwardly to an interior mouth diameter 92. In some embodiments, the mouth diameter 92 is about 101-110% of the clearance band interior diameter 80, in certain embodiments the mouth diameter 92 is about 0.0005-0.0100" greater than the clearance band interior diameter. In certain embodiments, the mouth 90 comprises the terminal edge 550. In embodiments, the mouth 90 is flared along both interior and exterior sides.

In embodiments such as FIG. 5, the clearance band 560 comprises the mouth 90. Because the clearance band 560 already provides an increased interior diameter (e.g., clearance diameter 80), the mouth 90 does not need to flare outwardly as far as with conventional necks.

As shown in FIG. 5 and applicable to any embodiments, a projectile 100 is mounted in the two-stage neck 32, 532, the projectile comprising an ogive portion 102 having an ogive length 104, a mid portion 106 having a mid length 108, and a rear portion 110 having a rear length 112. The projectile 100 comprises an exterior surface 114, a portion of which engages the two-stage neck 32, 532 at least at the interference band 58.

In certain embodiments, the interior diameter (e.g., interference diameter 64) of the interference band 58 is the same as or less than the diameter of the projectile 100, causing the interference fit. Interference fit, as used herein, is known term of art, sometimes also referred to as press fits and/or shrink fits, referring to a traditional method for joining cylindrical parts. Generally, in an interference fit, the inner part, such as a shaft, bearing, bushing, or in our case a projectile, is machined to be bigger (e.g., have a larger width, diameter, etc.) than the mating opening (e.g., interference diameter) of the outer part, such as a housing, or casing 22. The larger part is then forced (e.g., pressed) into the smaller part, causing both parts deform slightly and fit together. This method of joining creates extremely high friction between two parts (e.g., larger part and smaller part) that can withstand large amounts of torque without separation of the parts.

In certain embodiments, the interference diameter 64 is about 0.0010" less than the projectile diameter, more generally about 0.0005"-0.0015", more generally the interference diameter 64 is smaller than the projectile diameter by about 0.0020" or less. In some embodiments, the clearance band 560 is at least partially coextensive with the ogive portion 102, thereby accommodating a longer ogive length 104 than would otherwise fit in a conventional neck having only the interference diameter 64.

In any of the disclosed embodiments, at least a portion of the projectile 100 is coextensive with both the interference band 58 and the clearance band 60, 560. In certain embodiments, the projectile 100 is not in contact with the clearance band 60, 560 (i.e., clearance fit). In embodiments, the projectile 100 comprises the exterior surface 114 that does not conform in shape to the clearance band 60, 560. In other embodiments, the exterior surface partially conforms to the clearance band 60, 560 and/or the transition 62, but does not touch the entire length 68 of clearance band 60.

In certain embodiments, the mouth 90 is spaced from the exterior surface 114 of the projectile 100 to form a mouth gap 94. In such embodiments, a sealant 98 may be provided between the mouth 90 and the projectile 100. Applicable sealants include UV-cured sealants, or anaerobic sealants, other wicking sealants, or other waterproofing sealants, and any other sealant used for this purpose in the cartridge field.

In embodiments with a clearance fit for the clearance band 60, 560, a radial gap 96 is formed between the interior surface 582 of the clearance band 560 and the exterior surface 114 of the projectile 100. In certain embodiments, the radial gap is about 0.001-0.005". In embodiments with or without a mouth 90, a sealant may be provided at the radial gap 96 between the clearance band 60, 560 and the projectile 100 in the same manner as sealant 98.

Figure 6:
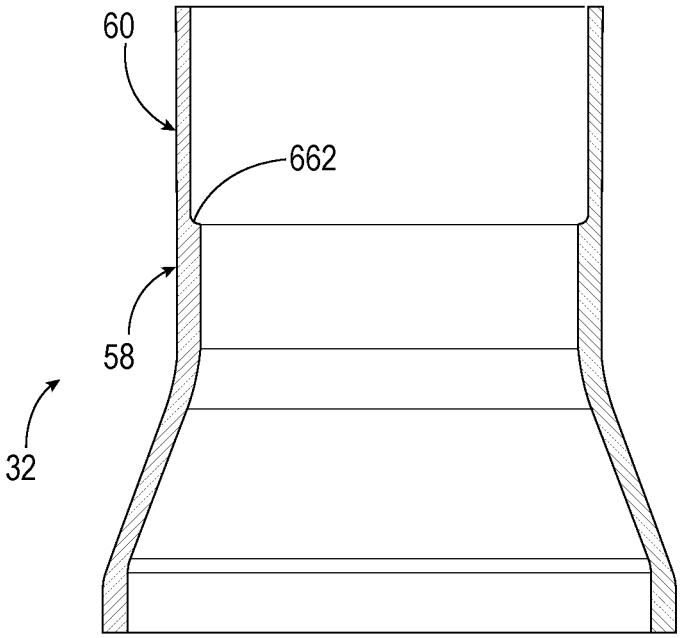
FIG. 6 is a partial zoomed view of another embodiment of a case of FIG. 1 in accord with embodiments of the present disclosure.
Figure 7:
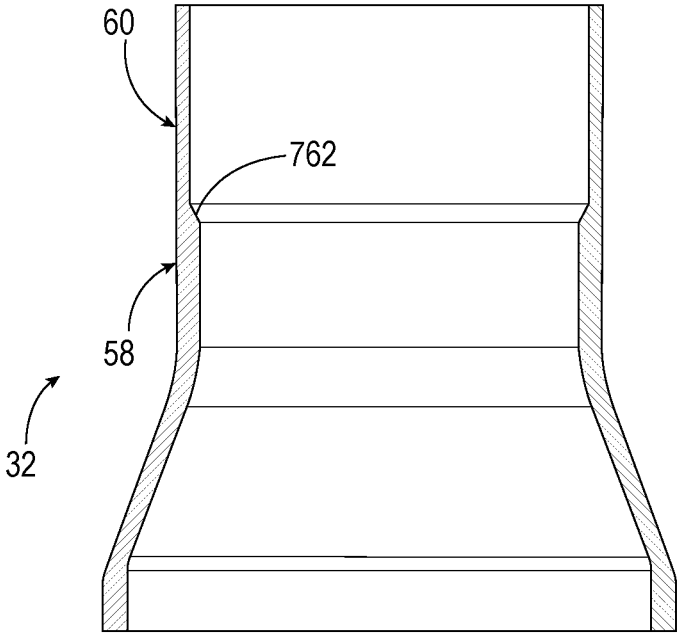
FIG. 7 is a partial zoomed view of another embodiment of a case of FIG. 1 in accord with embodiments of the present disclosure.

Referring to FIGS. 6 and 7, various embodiments with different arrangements of the transition 62 between the interference band 58 and the clearance band 60 are shown, with the remainder of the two-stage neck 32 being substantially similar. Instead of the step shape of FIGS. 1-2, FIG. 6 shows a transition 662 that is a curve between the bands. FIG. 7 shows a transition 762 that is a gradient angled between the bands. The transition 762 is illustrated as angled at about 45 degrees, but may be at any angle between 0 and 90 degrees.

In some embodiments, the cartridge 20 conforms to standardized dimensions, for example dimensions established by the Sporting Arms and Ammunition Manufacturers' Institute, Inc. (SAAMI). The standardized dimensions cover both a cartridge and corresponding firearm with acceptable tolerance ranges, for example a neck diameter and a chamber diameter. It will be appreciated that embodiments of the two-stage neck 32 of the present disclosure will provide the exterior clearance diameter 88 that is less than the smallest possible chamber diameter of the tolerance range for a given standardized cartridge. Accordingly, in embodiments, the case 22 is configured for a cartridge of standardized cartridge dimensions comprising a predetermined projectile diameter and the interference diameter 64 of the interference band 58 is less than the predetermined projectile diameter and the clearance diameter 80 of the clearance band 60 is slightly less than, equal to, or greater than the predetermined projectile diameter, but the exterior diameter 88 of the clearance band 60 must remain smaller than the chamber diameter. As one example, the SAAMI specifications for a 308 Winchester include maximum cartridge neck diameter of 0.3435" at the mouth while the minimum chamber diameter is 0.3442" at the mouth, therefore corresponding clearance band 60 will have an exterior diameter 88 that must be less than 0.3442" but may be greater than 0.3435". In embodiments, the neck length 52 remains in conformance with the standardized cartridge dimensions.

Embodiments of the present disclose provide a method for forming a case 22 (e.g., an ammunition case). In embodiments, the method comprises drawing and forming a body, a base at one end of the body, and a neck at an opposite end of the body, the neck comprising: a neck length extending from the body to a terminal edge, an exterior surface, and an interior surface comprising an interference diameter; and increasing the interior surface of the neck to form a clearance band comprising a clearance diameter greater than the interference diameter, wherein the expanding is performed along about 15% to about 85% of the neck length.

In certain embodiments, the increasing step is performed by punching the neck with a die. For example, after the neck is formed with an inner diameter equal to the interference diameter 64, a punch having an outer diameter equal to the clearance diameter 80 is driven axially into the neck. The depth of the punch provides the clearance length 84 of the clearance band 60. In other embodiments, the increasing step is performed by boring out the two-stage neck 32 in the desired location of the clearance band 60.

Case materials applicable to the present disclosure include metals and non-metals. Some embodiments of the case 22 are formed from a high-strength metal such as brass, steel, steel alloys, steel-boron alloys, high-strength aluminum, and the like. In embodiments, the case 22 is formed of a steel-boron alloy comprising about 0.001%-0.500% boron by weight, other steel-boron alloys comprise less than about 0.500% boron by weight, less than about 0.400% boron by weight, less than about 0.300% boron by weight, less than about 0.200% boron by weight, less than about 0.100% boron by weight, about 0.001-0.100%, about 0.001-0.050%, about 0.001-0.010%, and about 0.001-0.005%. Various other case materials are also contemplated herein, such as, for example, as disclosed in U.S. Patent Application Publication No. 2022/0097124, filed Sep. 24, 2021, entitled BORON STEEL HIGH-PRESSURE CARTRIDGE CASE, which is hereby incorporated by reference herein in its entirety.

In some embodiments, relative to a conventional brass case, the greater rigidity and modulus of elasticity in high-strength metals may provide functional benefits but may also have a significant impact on retention force. Many conventional arrangements of a cylindrical neck for a brass case rifle cartridge yield retention forces that are less than or equal to about 150 pounds of force (lbf), whereas a steel alloy case with the same design (including the same neck design) can yield retention forces that are 3-4× greater and significantly higher muzzle energy. By contrast, embodiments of the present disclosure provide the benefits of a high-strength case with comparable retention force to brass. In embodiments of the present disclose comprising a case 22 formed of a high-strength metal, e.g., steel or boron-steel, the two-stage neck 32 provides a retention force comparable to brass, in particular a retention force of about 25-150 lbf on the projectile, less than or equal to about 150 lbf, less than or equal to about 200 lbf, or less than or equal to about 250 lbf.

The disclosed embodiments may be beneficial for using steel or other relatively high-strength materials for the case 22 with retention forces that are comparable to brass. Such high-strength case materials may offer strength, cost, and manufacturability benefits as compared to conventional configurations and materials, particularly for modern military applications. Nonetheless, applicable embodiments of case materials also include brass or other relatively low-strength materials.

As discussed above, in certain embodiments, the clearance band 60 may preclude the need for a mouth 90 or reduce the amount of mouth flare required for proper assembly and seating of the projectile 100. This may provide various benefits, such as utilizing less ductile metals and/or simpler manufacturing processes. In a similar manner, the design of the interference band 58 may be tuned to a desired interference retention force that precludes or reduces the need for crimping after the projectile is seated. Because forming a mouth and/or crimp strain the metallic material and damage the integrity of the surface (for example, a plated surface), embodiments of the present disclose provide improved surface integrity for the interior and exterior surfaces of the two-stage neck 32. As a result, the two-stage neck 32 may be less susceptible to corrosion than conventional designs, which may obviate the need for costly material choices or corrosion mitigation manufacturing steps Various modifications to the above examples are contemplated to be within the scope of the present disclosure. The various angled or curved surfaces of the transition 62, interior surface 82 of the clearance band 60, mouth 90 may be varied without departing from the scope of the disclosure. The case 22 may have various modifications in the body 24, shoulder 34, and/or base 36.

Embodiments of the present disclosure are applicable to various types, sizes, and uses of ammunition cartridges. For example, the two-stage neck 32 may be implemented for casings of typical military cartridges such as 5.56 mm NATO, 6.5 mm, 6.8 mm, 7.62 mm NATO, 338 cal., and .50 BMG. In embodiments, projectiles may be lead, lead-free, jacketed, or non-jacketed. The present disclosure may also be applicable to centerfire as well as rimfire cartridges, as well as various types of firearms including handguns, rifles, semiautomatics, automatics, combinations thereof, and the like. Applicable rifles may include match, sporting, and shotgun styles.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A cartridge for a firearm, comprising:

a projectile; and a case, comprising:

a base configured to hold a primer, a body extending from a first end adjacent the base to a second end, and a two-stage neck extending from the second end of the body to a mouth and configured to retain the projectile, the two-stage neck comprising a neck length, an interior surface, and an exterior surface, wherein the mouth is defined by a radially outwardly flaring of the interior surface and the exterior surface, the interior surface of the two-stage neck comprising:

an interference band, adjacent the second end of the body, comprising an interference diameter and extending an interference length along the two-stage neck, the interference band configured to provide an interference fit with the projectile resulting in an interference retention force, a clearance band, adjacent the mouth of the two-stage neck, comprising a clearance diameter and extending a clearance length along the two-stage neck, the clearance diameter being greater than the interference diameter, and a transition portion located between and adjoining the interference band and the clearance band, wherein both the interference band and the clearance band are at least partially coextensive with the projectile, and wherein one or more of the interference length and the clearance length comprise about 25% or more of the two-stage neck length.

2. The cartridge of claim 1, wherein the exterior of the two-stage neck comprises a reduced diameter relative to the body, the case further comprising a shoulder extending from the second end of the body to the two-stage neck, wherein the interference band extends from the shoulder to the clearance band.

3. The cartridge of claim 1, the mouth comprising a mouth diameter selected from one of: being about 101-110% of the clearance diameter or being about 0.0005-0.0100 in. greater than the clearance diameter.

4. The cartridge of claim 1, wherein the clearance diameter is consistent along the clearance band to the mouth of the two-stage neck.

5. The cartridge of claim 1, wherein the projectile comprises an exterior surface that does not conform to the clearance band.

6. The cartridge of claim 1, wherein at least a portion of the projectile is both coextensive with the clearance band and not in contact with the clearance band.

7. The cartridge of claim 1, the clearance band comprising a cylindrical inner surface of substantially consistent diameter, and the interference band comprising a cylindrical inner surface of substantially consistent diameter.

8. The cartridge of claim 1, comprising only a single transition in the two-stage neck between the interference band and clearance band, the single transition selected from one of a step, a gradient, and a curve.

9. The cartridge of claim 8, wherein the projectile does not comprise a feature or shape complementary to the single transition in the two-stage neck.

10. The cartridge of claim 1, the exterior of the two-stage neck comprising an exterior diameter at the clearance band that is greater than an exterior diameter at the interference band.

11. The cartridge of claim 1, further comprising a radial gap between the projectile and the clearance band, wherein the radial gap is within a range from about 0.001 inches to about 0.005 inches.

12. The cartridge of claim 1, further comprising a sealant between at least a portion of the clearance band and at least a portion of the projectile.

13. The cartridge of claim 1, wherein the interference band provides substantially the entire interference retention force of the projectile in the case.

14. The cartridge of claim 1, wherein the case is configured for a cartridge of standardized cartridge dimensions comprising a predetermined projectile diameter, and wherein the neck length conforms to the standardized cartridge dimensions.

15. The cartridge of claim 1, wherein the case is configured for a cartridge of standardized cartridge dimensions comprising a predetermined projectile diameter, and wherein the interference diameter is less than the predetermined projectile diameter and the clearance diameter is equal to or greater than the predetermined projectile diameter.

16. The cartridge of claim 1, wherein the case comprises a material selected from steel and a steel alloy.

17. A cartridge for a firearm, comprising:

a projectile; and a case, comprising:

a base configured to hold a primer, a body extending from a first end adjacent the base to a second end, and a two-stage neck extending from the second end of the body to a forward mouth and configured to retain the projectile, the two-stage neck comprising:

an interference band adjacent the second end of the body, the interference band having an interference diameter and configured to provide an interference fit with the projectile, a clearance band forward of the interference band and having a clearance diameter greater than the interference diameter, the clearance band configured to provide one of a reduced interference fit with the projectile compared to the interference band, a line-to-line fit, or a clearance fit, and a transition portion between the interference band and the clearance band, wherein the interference band and the clearance band are at least partially coextensive with the projectile, and wherein an exterior diameter at the clearance band is greater than an exterior diameter at the interference band.

18. The cartridge of claim 17, wherein the reduced interference fit is defined by the clearance diameter being less than a diameter of the projectile, wherein the line-to-line fit is defined by the clearance diameter being substantially equal to the projectile diameter, and wherein the clearance fit is defined by an interior surface at the clearance band being radially spaced from the projectile.

19. A cartridge for a firearm, comprising:

a projectile; and a case, comprising:

a base configured to hold a primer;

a body extending from a first end adjacent the base to a second end; and a two-stage neck comprising an interior surface and an exterior surface, the two-stage neck extending from the second end of the body to a mouth, the mouth configured to receive therethrough the projectile, wherein the two-stage neck defines:

an interference band adjacent the second end of the body, the interference band having an interference diameter and extending an interference length along the two-stage neck, the interference diameter configured to provide an interference fit with the projectile resulting in an interference retention force, a clearance band adjacent the mouth, the clearance band having a clearance diameter and extending a clearance length along the two-stage neck, the clearance diameter being greater than the interference diameter, wherein a diameter of the exterior surface at the clearance band is greater than a diameter of the exterior surface at the interference band, and a transition portion located between and adjoining the interference band and the clearance band.

20. The cartridge of claim 19, wherein the mouth is flared radially outwardly at both the interior surface and exterior surface.

* * * * *